United States Patent [19]

Butcher et al.

[11] Patent Number: 4,784,548

[45] Date of Patent: Nov. 15, 1988

[54] DOUBLE-STACKED FREIGHT CAR

[75] Inventors: Ronald S. Butcher; Mohamed A. Khattab, both of Burlington, Canada

[73] Assignee: National Steel Car Limited, Hamilton, Canada

[21] Appl. No.: 918,041

[22] Filed: Oct. 14, 1986

[30] Foreign Application Priority Data

Jan. 22, 1986 [CA] Canada ..... 500129

[51] Int. Cl.[4] ..... B60P 3/40

[52] U.S. Cl. ..... 410/54; 410/80; 410/94; 105/355

[58] Field of Search ..... 105/355, 238.1; 410/52, 410/54, 71, 80, 2, 77, 94

[56] References Cited

U.S. PATENT DOCUMENTS

| | | | |
|---|---|---|---|
| 3,444,824 | 5/1969 | Gutridge | 410/54 |
| 3,552,325 | 1/1971 | Enochian | 410/54 |
| 4,091,741 | 5/1978 | Hartkorn | 410/71 X |
| 4,624,188 | 11/1986 | Kaleta | 105/355 |

*Primary Examiner*—Robert B. Reeves
*Assistant Examiner*—Russell D. Stormer
*Attorney, Agent, or Firm*—Ridout & Maybee

[57] ABSTRACT

A freight car according to the present invention has a longitudinally extending main load bearing frame and a floor structure supported thereby, the floor structure being adapted to receive and support a lower freight container of a first standard length. End support structures at opposite ends of the floor structure are connected to the main load bearing frame and extend upwardly therefrom to a level above the height of the lower container. Each end structure further provides a plurality of pairs of laterally spaced corner supports each adapted to receive a respective corner portion of an upper container to be transported, the corner supports of each pair being longitudinally aligned with the corresponding corner supports of the other end support structure and cooperative therewith to support an upper container of a respective standard length above and independently of the lower container.

8 Claims, 6 Drawing Sheets

DOUBLE-STACKED FREIGHT CAR

Field of the Invention

This invention relates to freight cars and is concerned particularly with freight cars for transporting double-stacked containers.

BACKGROUND OF THE INVENTION

Freight containers are typically of rectangular box shape, and are produced in various standard lengths. The common standard lengths are 20, 40,44 ¼, 45 and 48 feet. Each container has a flat rectangular base with corner portions and is normally fitted with corner fittings providing support and means for lifting and interlocking.

In the past, freight containers have been transported on railway flat cars in a single layer and in lengths not exceeding 89 feet, which is the conventional length restriction on individual cars. In recent times, however, with a view to making freight transportation more economic, new car designs have been developed which permit the stacking of freight containers two high. These designs have been successful and various rail systems have now succeeded in expediting service by running double-stack container trains.

The typical approach to the problem of double-stacking is to design a car with a well to accommodate a 40 foot container, (or alternatively two 20 foot containers end to end) and to stack an upper container above it. The upper container may be 40 or 45 feet long and relies on the lower container for vertical support. The lower container may also provide horizontal support through an interlocking device. In cases in which the upper and lower containers are of different standard lengths, for example where the upper container is longer than the lower container, then the upper container must be fitted with additional corner fittings at the 40 foot position, i.e. to engage the fittings of the lower container, in order to receive vertical and possibly horizontal support. This considerably complicates the container structure.

SUMMARY OF THE INVENTION

The present invention provides an improved design of freight car for transporting double-stacked containers wherein the upper container is supported by the load bearing structure of the car independently of the lower container, the support means being adapted to accommodate containers of different standard lengths.

Thus, a freight car according to the present invention has a longitudinally extending main load bearing frame and a floor structure supported thereby, the floor structure being adapted to receive and support a lower freight container of a first standard length. End support structures at opposite ends of the floor structure are connected to the main load bearing frame and extend upwardly therefrom to a level above the height of the lower container. Each end structure further provides a plurality of pairs of laterally spaced corner supports each adapted to receive a respective corner portion of an upper container to be transported, the corner supports of each pair being longitudinally aligned with the corresponding corner supports of the other end support structure and cooperative therewith to support an upper container of a respective standard length above and independently of the lower container.

DESCRIPTION

A freight car according to a preferred embodiment of the invention includes a main load bearing frame extending longitudinally with respect to the freight car; a floor structure supported by the main load bearing frame for receiving and supporting a lower freight container of a first standard length; end frame assemblies at opposite ends of the floor structure, each end frame assembly including an upright frame structure connected to the main load bearing frame and extending therefrom to a level above the height of the lower container; each end frame assembly providing first and second pairs of corner supports at said level, the corner supports of each pair being longitudinally aligned with the corresponding corner supports of the other end frame assembly and being adapted to cooperate therewith for receiving and supporting an upper container above and independently of the lower container; said first pairs of corner supports being positioned to receive and support an upper container of at least said first standard length, and said second pairs of corner supports being positioned to receive and support an upper container of an alternative second standard length greater than the first; and means for selectively moving said first pairs of corner fittings from a normal load supporting position to a retracted position at which they do not obstruct loading of an upper container of said second standard length.

Preferably each end frame assembly further provides a third pair of laterally spaced corner supports at said level, the corner supports of said third pair being longitudinally aligned with the corresponding corner supports of the other frame assembly and being adapted to cooperate therewith for receiving and supporting an upper container of a third standard length greater than the second, and wherein the corner supports of said second pairs include retractable supporting elements and means for displacing said elements to a retracted position at which they do not obstruct loading of an upper container of said third standard length.

BRIEF DESCRIPTION OF THE DRAWINGS

In order that the invention may be readily understood one embodiment thereof will now be described, by way of example, with reference to the accompanying drawings. In the drawings.

DETAILED DESCRIPTION OF THE PREFERRED EMBODIMENT

Figure 1:
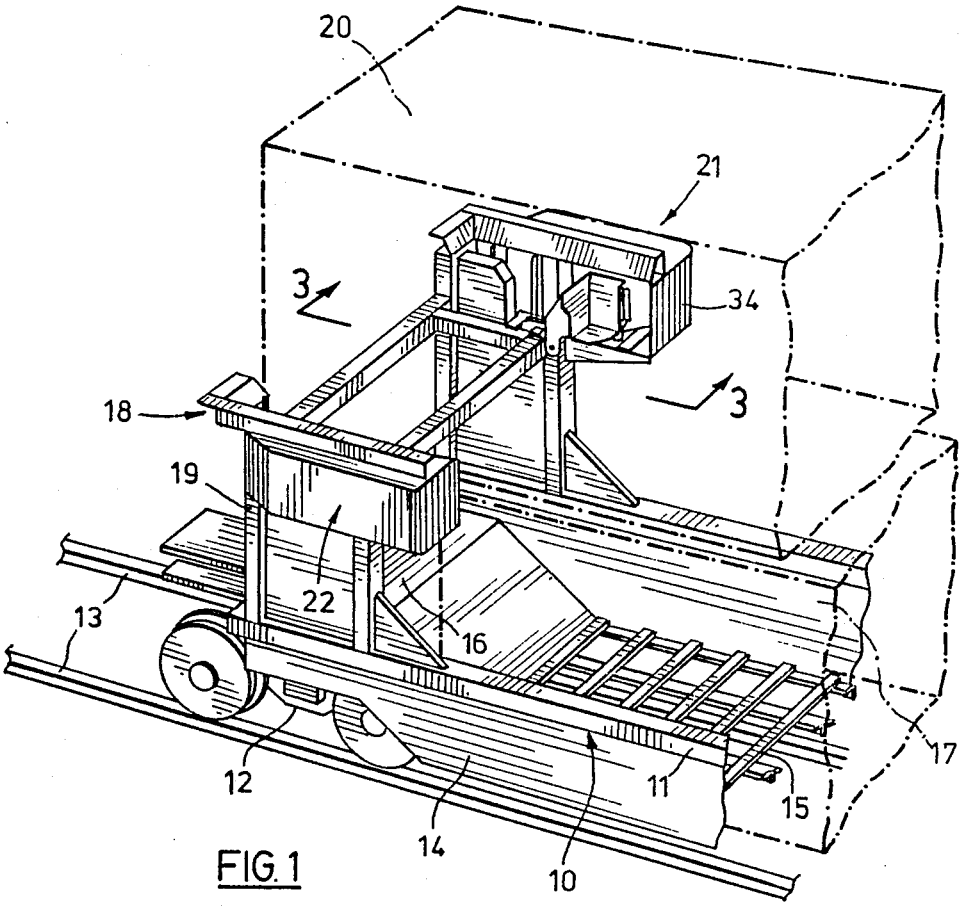
FIG. 1 is a perspective view, partly broken away, of an end portion of a freight car according to the invention.

Referring to the drawings, FIG. 1 shows an end portion of the freight car. The opposite end portion is identical and is not shown separately. The freight car is constructed in accordance with standard practice, the car having a longitudinally extending main load bearing frame 10 formed by side beams 11 along with end channel members (not shown), and is mounted at its ends on trucks 12 which run on tracks 13. Side skins or walls 14 extending from the beams 11 form stress panels which transmit load stresses to the main load bearing frame 10. Supported by the main load bearing frame is a floor structure 15, forming a well extending between end deck plates 16. The well of the floor structure 15 is of such a length as to receive and support a lower freight container 17 of a first standard length. In the present example the lower container 17 is a 40 foot container, or alternatively it may be replaced by a pair of 20 foot containers arranged end to end.

The construction described so far is conventional. However, a characteristic feature of the present invention is that end frame assemblies 18, or end support structures, are provided on the car at opposite ends of the floor structure 15, each assembly 18 including an upright frame structure 19 which is connected directly to the main load bearing frame 10 and extends upwardly from it to a level above the height of the lower container 17. FIG. 1 shows just one of these end frame assemblies. It is to be understood that the other end frame assembly, at the opposite end of the car, is identical to it.

For the purpose of receiving and supporting an upper freight container 20, whose length may be any one of, say, three different standard lengths, each upright frame structure 19 carries at its upper end a pair of laterally spaced, specially constructed, support mechanisms 21, 22. The support mechanisms 21, 22 are of identical construction and are arranged symmetrically with respect to the longitudinal medial plane of the car. The construction of the support mechanisms will now be described with reference to FIGS. 2 to 6.

Figure 2:
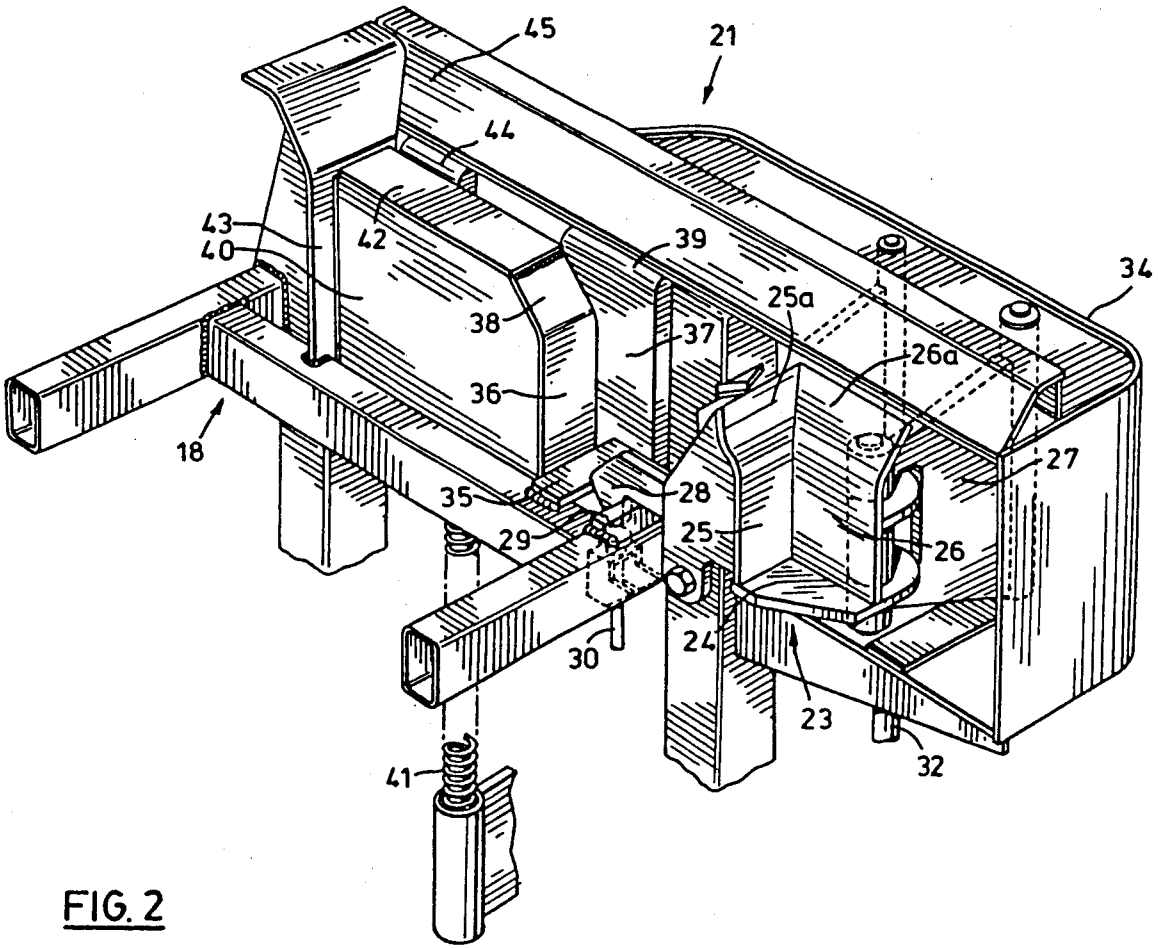
FIG. 2 is an enlarged perspective view of one container support mechanism shown in FIG. 1.

Essentially, the support mechanism 21 shown in FIG. 2 provides three corner supports each of which is laterally spaced from the respective corresponding corner support of the support mechanism 22 by a distance equal to the width of an upper container to be transported. The corner supports are configured to receive and support respective corner portions of the container, and are longitudinally aligned with the corresponding corner supports of the support mechanisms carried by the end frame assembly at the other end of the car.

Figure 6:
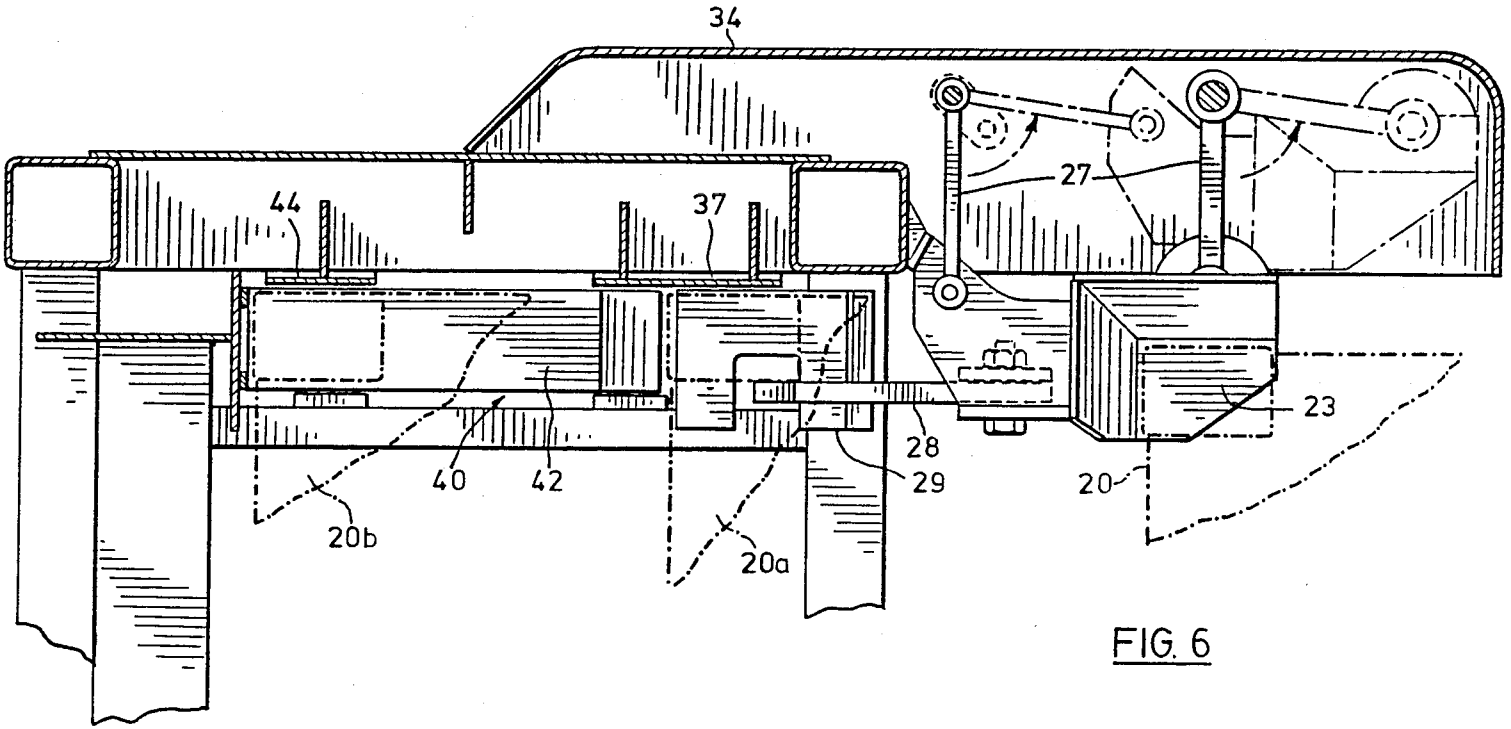
FIG. 6 is a plan view of the support mechanism showing the respective positions of corner supports for supporting freight containers of three standard lengths.

The first of the three corner supports of the mechanism 21, shown in FIG. 2, is constructed as a chair 23 formed by three mutually perpendicular plates 24, 25 and 26. As best shown in FIG. 6, the chair 23 is mounted on a four-bar mechanism 27 by which it is articulately connected to the upright frame structure 18. The plates 24, 25 and 26 provide three mutually perpendicular support surfaces, namely a horizontal support surface for supporting a vertical load, a first vertical support surface for supporting horizontal longitudinal loads and a second vertical surface for supporting horizontal transverse loads, respectively. The upper end portions 25*a*, 26*a* of the plates 25, 26 are shaped to provide guide ramps for guiding the corner portion of an upper freight container into the chair to be supported thereby. The four corner supports 23 (two in each end frame assembly), when in their operative load supporting positions, are thus positioned in relation to one another so as to receive and support an upper container 20 independently of the lower container 17, the load being transmitted directly to the main load bearing frame via the frame structures 18. In this case, the upper container 20 is of a first standard length at least equal to that of the lower container 17.

Figure 3:
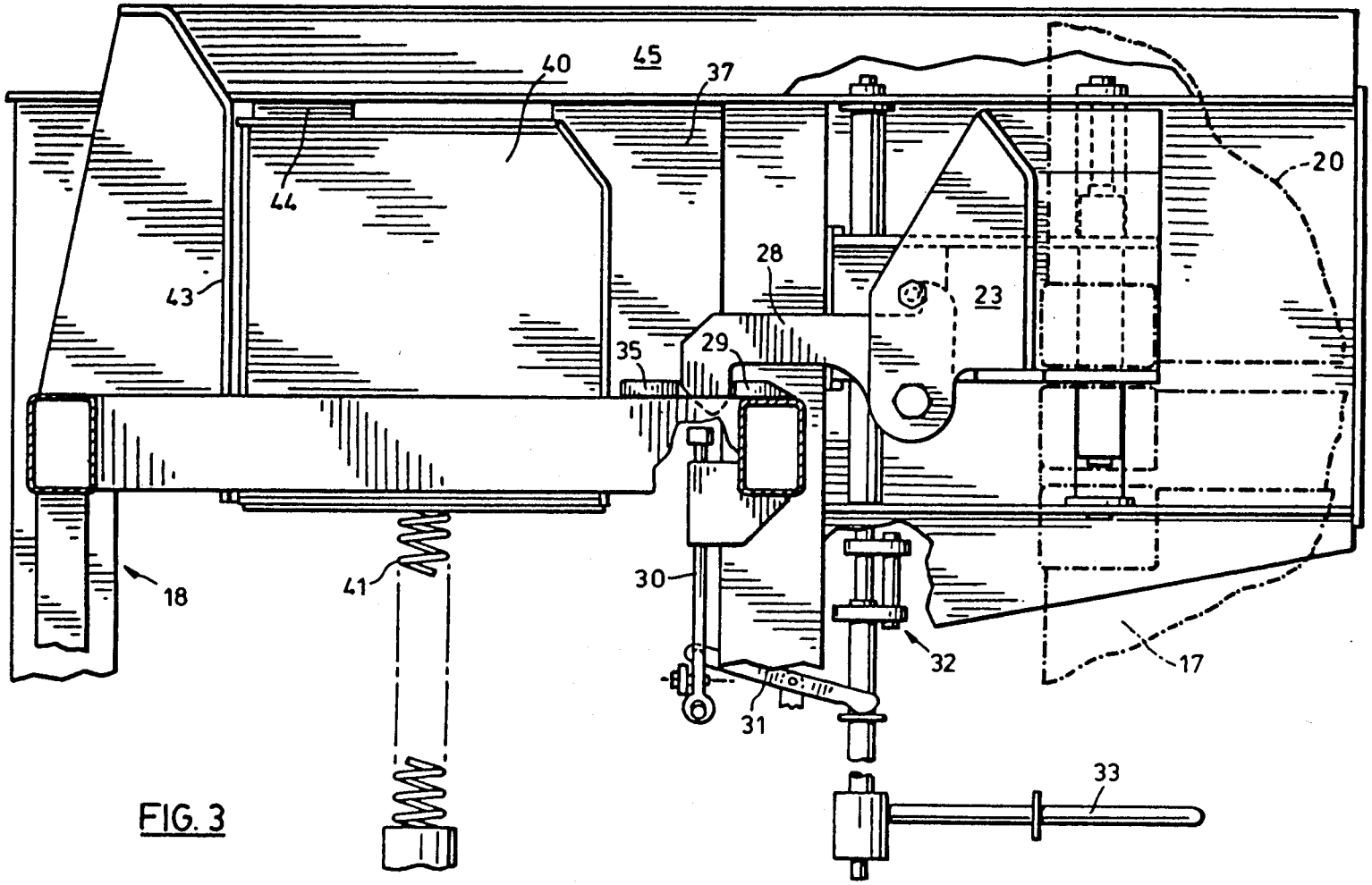
FIG. 3 is a side elevational view of the support mechanism shown in FIG. 2, the support mechanism supporting a container of a first standard length.
Figure 4:
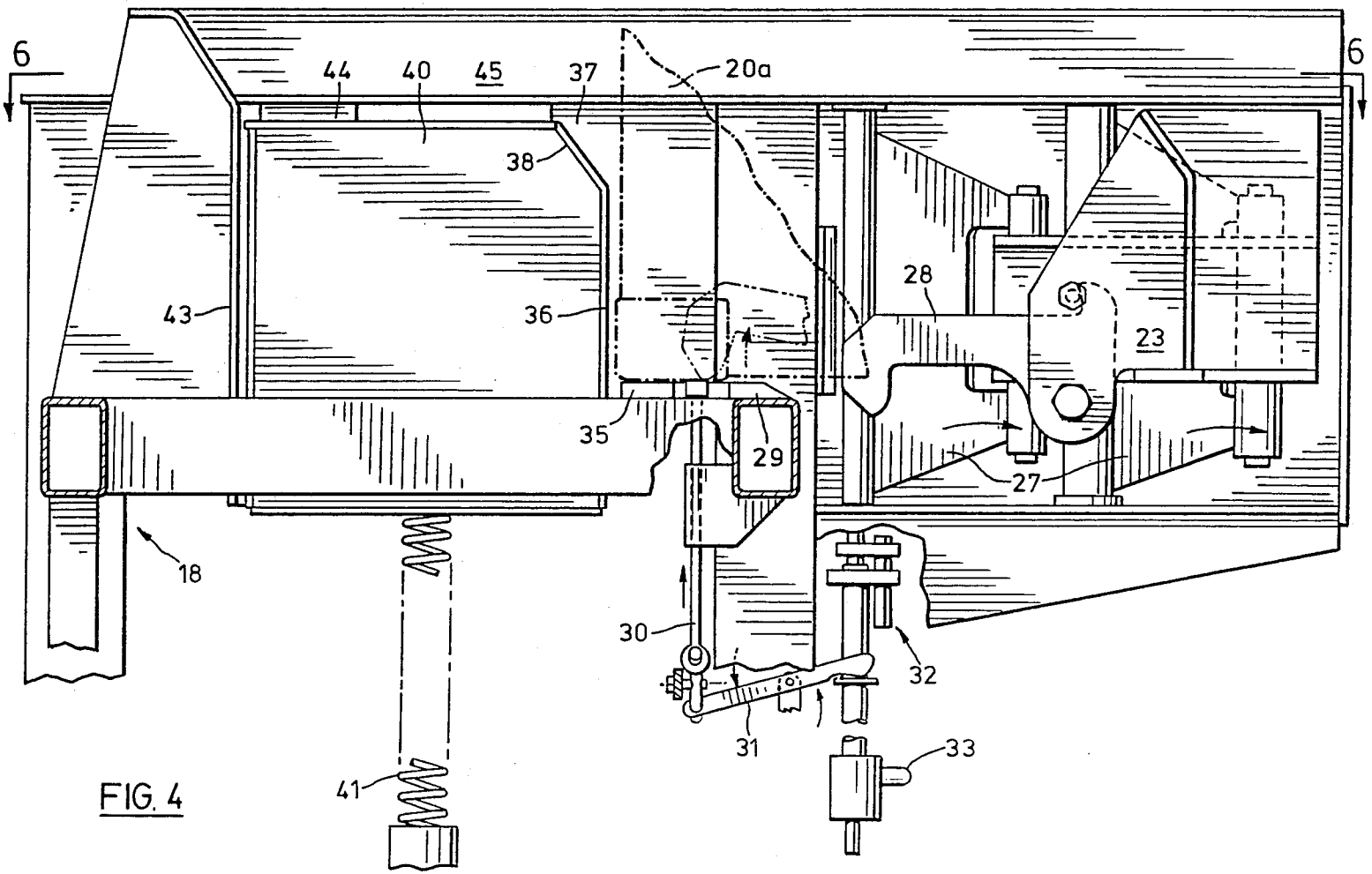
FIG. 4 is a view similar to FIG. 3 but showing the support mechanism supporting a container of a second standard length greater than the first.
Figure 5:
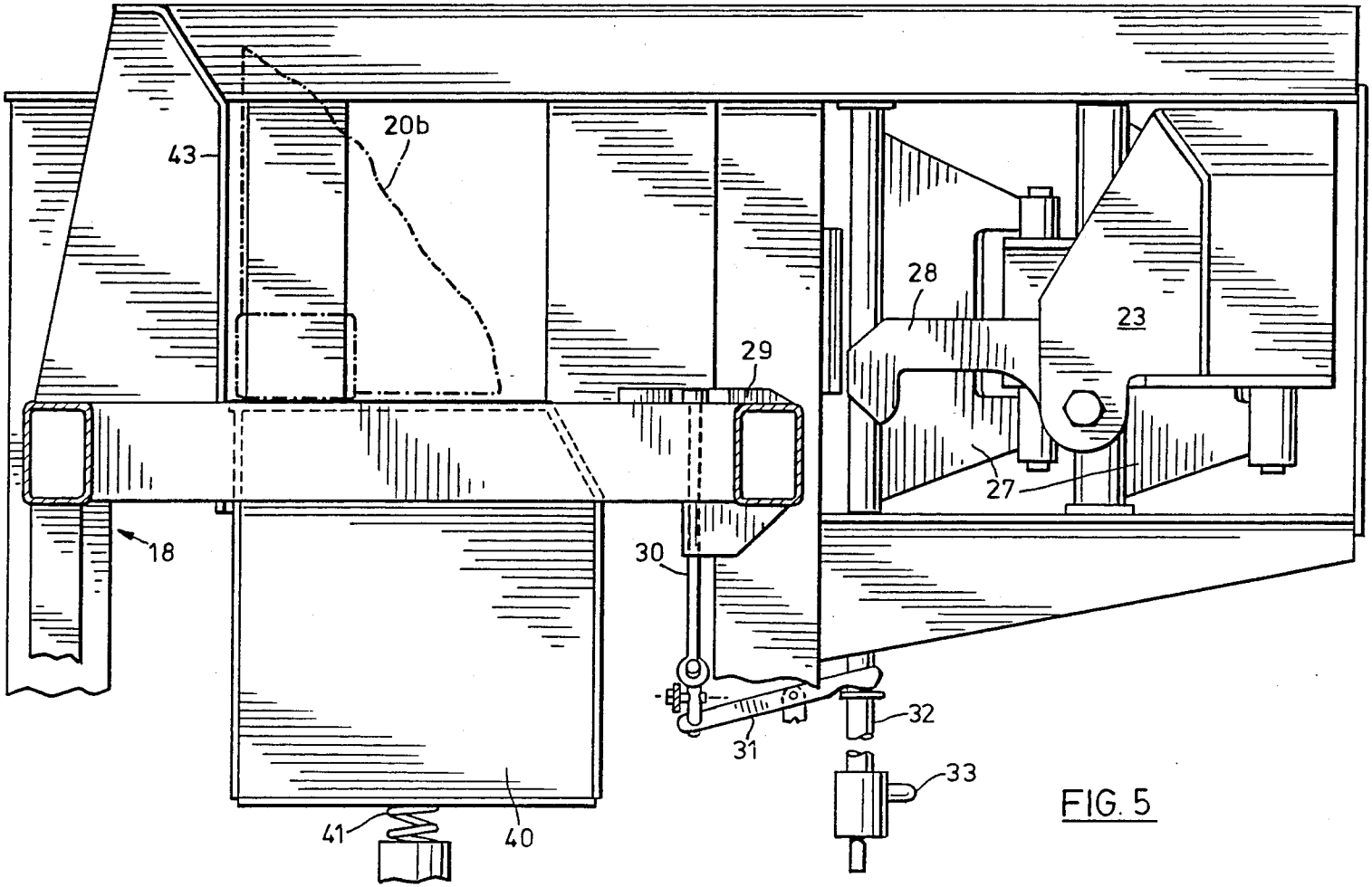
FIG. 5 is a view similar to FIG. 3 but showing the support mechanism supporting a container of the maximum standard length.

As shown also in FIG. 3, each corner support 23 is secured in operative load supporting position by a latch 28, which is engageable with a latch plate 29 mounted on the frame structure. FIG. 3 also shows a control mechanism for swinging the corner support 23 away from its operative position to a retracted position when required. The mechanism includes a latch release finger 30 which is engageable with the latch member 28 to release the latter from the latch plate 29 when required. The finger 30 is operated through a lever mechanism 31 by a crank mechanism 32 having an operating handle 33. The crank mechanism 32 has clearances such that rotation of the handle 33 by approximately one half turn will rotate the four-bar mechanism 27 somewhat less than one quarter turn. In order to retract the corner support 23 from its operative position, the operator must raise the handle 33 thereby actuating the finger 30 to release the latch member 28. The handle can then be swung horizontally, thereby rotating the crank mechanism 32 and actuating the four bar mechanism 27. In this way the corner support 23 is retracted into a housing 34. The housing 34 is mounted on the end frame structure 18 and is laterally offset therefrom. Thus, when the first corner supports 23 have been retracted, they do not present any obstruction to the loading of an upper container 20*a* (FIG. 4) of a second standard length greater than the first. This will now be described.

The second corner support of the mechanism 21, is also designed to receive a respective corner portion of an upper freight container and for this purpose is constructed to provide three mutually perpendicular support surfaces, namely, a horizontal surface 35 to support a vertical load, a vertical surface 36 to support horizontal longitudinal loads, and a vertical surface 37 to support horizontal transverse loads. The upper end portions of the vertical surfaces 36 and 37 are shaped to provide guide ramps 38, 39 for guiding the corner portion of a freight container being loaded. The support mechanism 21 is one of four support mechanisms which are identically constructed, the second corner supports thereof being cooperatively positioned in relation to one another so as to receive and support an upper container 20*a* independently of the lower container. In this case, as previously noted, the container 20*a* is of a second standard length greater than that of the lower container 17.

Now the vertical face 36 of the second corner support is formed by one longitudinal side face of a retractable plunger or block 40. This plunger is normally biased upwardly into the extended position shown in FIGS. 1–4 by a compression spring 41 attached to the end frame structure 18. However, if an upper container 20*b* (FIG. 5) of a third standard length greater than the first or second is loaded onto the car, the plunger 40 is retracted against the bias of spring 41 under the weight of the container. Thus, retraction of the plunger 40 exposes the third corner support defined by three mutually perpendicular support surfaces defined respectively by an upper horizontal surface 42 of the plunger 40, and vertical plates 43, 44. The plate 43 is shaped to provide a guide ramp for guiding the corner portion of a freight container 20*b* of the third standard length, and cooperates with an inclined ramp plate 45 to define a flared entrance to the support mechanism.

The third corner supports of the four support mechanisms are cooperatively positioned in relation to one another so as to receive and support an upper container 20*b* independently of the lower container.

Although the invention has been particularly described with reference to the transportation of freight containers selected from three standard lengths, the invention in its broadest aspect is applicable generally to freight cars for transporting containers selected from two or more standard lengths. Moreover, even with the arrangement particularly described herein, it is clear that the freight car can be used to transport containers selected from up to six standard lengths by suitably selecting the pairs of corner supports of the two assemblies.

Furthermore, it is envisaged that each of the corner support mechanisms 21, 22, at one or both ends of the freight car, may include two or more plungers 40 placed in series longitudinally with respect to the freight car, thereby to provide one or more additional corner supports to accommodate one or more additional standard lengths of container selected for transportation at the upper level.

We claim:

1. In a freight car for transporting double-stacked freight containers, each container having a rectangular base with corner portions:

a main load bearing frame extending longitudinally with respect to the freight car;

a floor structure supported by the main load bearing frame for receiving and supporting a lower freight container of a first standard length;

end frame assemblies at opposite ends of the floor structure, each end frame assembly including an upright frame structure connected to the main load bearing frame and extending therefrom to a level above the height of the lower container;

each end frame assembly providing first and second pairs of corner supports at said level, each corner support providing a load bearing surface to support the weight of a freight container, the corner supports of each pair being longitudinally aligned with the corresponding corner supports of the other end frame assembly and being adapted to cooperate therewith for receiving and supporting an upper container above and independently of the lower container;

said first pairs of corner supports being positioned to receive and support an upper container of at least said first standard length, and said second pairs of corner supports being positioned to receive and support an upper container of an alternative second standard length greater than the first; and means for selectively moving said first pairs of corner supports from a normal load supporting position to a retracted position at which they do not obstruct loading of an upper container of said second standard length.

2. The combination claimed in claim 1, wherein each corner support of said first pairs is constructed as a chair and the means for selectively moving said first pair of corner fittings is on a four-bar mechanism on which the chair is mounted and articulately connected thereby to the said upright frame structure, said four-bar mechanism constraining the chair for movement between its normal load supporting position and its retracted position, the assembly further including latching means for latching the chair in said normal load supporting position, means for operating and releasing the latching means, and a housing structure mounted on said frame structure, the housing being laterally offset from the frame structure and positioned to accommodate the chair in its retracted position.

3. The combination claimed in claim 1, wherein each end frame further provides a third pair of corner supports at said level, the corner supports of said third pair being longitudinally aligned with the corresponding corner supports of the other end frame assembly and being adapted to cooperate therewith for receiving and supporting an upper container of a third standard length greater than the second, and wherein the corner supports of said second pairs include retractable supporting elements and means for displacing said elements to a retracted position at which they do not obstruct loading of an upper container of said third standard length.

4. The combination claimed in claim 3, wherein each of said corner supports provides three mutually perpendicular support surfaces positioned to receive a respective corner portion of a freight container, namely a pair of vertical support surfaces for supporting horizontal longitudinal and transverse loads and a horizontal support surface for supporting a vertical load.

5. The combination claimed in claim 4, wherein the vertical support surfaces of each corner support are shaped to provide guide ramps for guiding the corner portion of a freight container being loaded.

6. The combination claimed in claim 4, wherein each corner support of said first pairs is constructed as a chair mounted on a four-bar mechanism and articulately connected thereby to the said upright frame structure, said four-bar mechanism constraining the chair for movement between its normal load supporting position and its retracted position, the assembly further including latching means for latching the chair in said normal load supporting position, means for operating and releasing the latching means, and a housing structure mounted on said frame structure, the housing being laterally offset from the frame structure and positioned to accommodate the chair in its retracted position

7. The combination claimed in claim 4, 5 or 6, wherein the corner supports of said second pairs each include a vertically retractable stop member providing a vertical thrust face defining a respective one of said vertical support faces for supporting horizontal longitudinal loads, and resilient means biasing the stop member to an operative load supporting position, the stop member being displaceable against the biasing means from the operative load supporting position to a retracted position by loading of a freight container of said third standard length.

8. In a freight car for transporting double-stacked freight containers of different standard lengths, the freight car having a longitudinally extending main load bearing frame and a floor structure supported thereby, the floor structure being adapted to receive and support a lower freight container of a first standard length, the improvement comprising end support structures at opposite ends of the floor structure, each end support structure being connected to the main load bearing frame and extending upwardly therefrom to a level above the height of a lower container to be transported, each end support structure further providing a plurality of pairs of laterally spaced corner supports each adapted to receive a respective corner portion of an upper container to be transported, the corner supports of each pair being longitudinally aligned with the corresponding corner supports of the other end support structure and cooperative therewith to support an upper container of a respective standard length above and independently of the lower container.

* * * * *